United States Patent [19]

Slonski

[11] Patent Number: 4,864,961

[45] Date of Patent: Sep. 12, 1989

[54] AUXILIARY FLOTATION SYSTEM

[76] Inventor: Richard M. Slonski, P.O. Box 93, Clinton, Conn. 06413

[21] Appl. No.: 206,601

[22] Filed: Jun. 14, 1988

[51] Int. Cl.[4] ..... B63B 43/14

[52] U.S. Cl. ..... 114/360; 114/68

[58] Field of Search ..... 114/360, 123, 68, 69

[56] References Cited

U.S. PATENT DOCUMENTS

| | | |
|---|---|---|
| 31,885 | 4/1861 | Goulard . |
| 387,933 | 8/1888 | Travis . |
| 1,133,629 | 3/1915 | Foster . |
| 1,309,875 | 7/1919 | Barniak . |
| 1,319,424 | 10/1919 | Schneider . |
| 3,026,839 | 3/1962 | Fridge . |
| 3,822,662 | 7/1974 | Morita et al. . |
| 3,952,350 | 4/1976 | Moucka . |

FOREIGN PATENT DOCUMENTS

| | | | |
|---|---|---|---|
| 258008 | 3/1988 | European Pat. Off. | 114/360 |
| 3413483 | 10/1985 | Fed. Rep. of Germany | 114/123 |
| 2184401 | 6/1987 | United Kingdom | 114/360 |

*Primary Examiner*—Sherman D. Basinger
*Attorney, Agent, or Firm*—Albert W. Hilburger

[57] ABSTRACT

Auxiliary flotation apparatus to provide supplemental flotation for a vessel which may be in danger of sinking. The apparatus is a self-contained cannister capable of being connected to a source of pressurized air. To assure stability of the disabled vessel, two or more of the cannisters would preferably be mounted at an outboard end to each side of the hull of the vessel at spaced locations below the water line. Should the need arise, the source of pressurized air can be manually or automatically activated for introduction into the cannister. In response to the pressurized air, a projectile is propelled in a direction away from the vessel and caused to rupture a frangible membrane located substantially flush with the hull of the vessel. The projectile proceeds far beyond the vessel and draws with it an attached inflatable tubular sheath of flexible, air impermeable sheet material. The tubular sheath has a continuous terminal rim distant from the projectile sealingly attached to an inboard end of the cannister. When the projectile has reached its limit of travel, the sheath becomes completely filled with air and expands to its full size as it extends outwardly from the hull, thereby providing buoyancy for the vessel.

17 Claims, 3 Drawing Sheets

PRESSURE SOURCE
METER
128
132
130
136
134
70
72
78
68
80
82
22
32
116
96
90
126
84
92
112
114
86
88
42
44
46
54
36
34
28
56
40
48
26
52
50
38
106
110
108
74
76

PRESSURE SOURCE
METER

AUXILIARY FLOTATION SYSTEM

BACKGROUND OF THE INVENTION

I. FIELD OF THE INVENTION

This invention relates generally to a safety device for a vessel and, more particularly, to a device of the type which can be automatically or manually activated to inflate externally of the hull of the vessel to thereby provide additional buoyancy in the event that the vessel is in danger of sinking.

II. DESCRIPTION OF THE PRIOR ART

Safety devices of the type which provide supplemental buoyancy for a vessel to guard against its sinking in time of danger have long been known. Typical of patents which disclose various arrangements for providing auxiliary flotation for a vessel by means of selectively inflatable buoyant members located along the hull of the vessel are U.S. Pat. No. 3,822,662 to Morita et al, U.S. Pat. Nos. 1,319,424 to Schneider, and 1,133,629 to Foster. Each of the former two patents disclose the use of an elongated inflatable bag extending a substantial distance along each of the port and starboard sides of the vessel. In the latter instance, a plurality of individual inflatable bags are provided at spaced locations along both the port and starboard sides of the vessel.

Another form of construction is disclosed in U.S. Pat. No. 3,952,350 to Moucka which discloses apparatus for automatically inflating a life raft secured to the side of a boat hull. The life raft is inflated by pressurized gas released from a cylinder activated when the boat capsizes.

In the instance of U.S. Pat. No. 3,026,839 to Fridge, a boat is provided with buoyant inflatable plastic members about portions of its periphery above the water line. The purposes of this construction are to prevent its capsizing by decreasing the pitch of the boat on sharp turns while the boat is travelling at high speeds and, also, to maintain the boat afloat in the event that it is capsized.

Still a different construction is provided in U.S. Pat. No. 1,309,875 to Barniak. This patent discloses a ship construction according to which, in the event of a disaster, the deck of the ship can be detached from the hull. Simultaneously, floats are inflated and positioned around the periphery of the deck for added buoyancy.

It was with knowledge of the current state-of-the-art as represented by the constructions just described that the present invention was conceived and has now been reduced to practice.

SUMMARY OF THE INVENTION

The present invention is directed toward auxiliary flotation apparatus which serves to provide supplemental flotation for a vessel which may be in danger of sinking. The apparatus is a self-contained cannister which, when installed, is located inboard of, and flush with, the hull. Being connected to a source of pressurized air, an inclinometer, and an independent power source, this system is essentially self-contained. To assure stability of the disabled vessel, two or more of the cannisters would preferably be mounted both fore and aft on each side of the hull of the vessel at spaced locations which are equidistant from the center of gravity and below the water line. An optimized system would be based on a marine engineer's calculations for exact mounting locations for any given vessel. Should the need arise, the source of pressurized air can be manually or automatically activated for introduction into the cannister. In response to the pressurized air, a projectile is propelled in a direction away from the vessel and caused to rupture one or more frangible membranes located substantially flush with the hull of the vessel. The projectile proceeds far beyond the vessel and draws with it an attached inflatable tubular sheath of flexible, air impermeable sheet material. The tubular sheath has a continuous terminal rim distant from the projectile sealingly attached to an inboard end of the enclosed cannister. When the projectile has reached its limit of travel, the sheath becomes completely filled with air and expands to its full size as it extends outwardly from the hull, thereby providing buoyancy for the vessel.

Unlike most instances of the prior art as already described, the invention is of a simplified, modular construction such that it could be inexpensively manufactured, installed, and maintained.

Each cannister is a self contained unit which enables it to be installed both as original equipment in new boats or, in the alternative, enables existing flush planked boats to be retrofitted to receive it. Metal vessels would require like metal cannisters in order to minimize the harmful effects of corrosion, although suitable non-metallic materials could also be employed. While each cannister can be readily installed, it can also, just as readily, be removed and replaced It is intended that the do-it-yourselfer will be properly instructed in the installation of the cannisters according the buoyancy requirements of that person's particular boat based on the previously mentioned calculations.

Another feature of the invention resides in the fact that it utilizes components fabricated from commonly available materials. Furthermore, those components which are lost, destroyed, or worn by reason of its use can be readily and easily replaced to return it to its original condition, again ready for use. Also, watertight integrity of the vessel would not be impaired by flotsam a each cannister is fully enclosed.

Still an additional feature of the self contained cannister design is the fact that it may be utilized with very large boats or with relatively small boats, the quantity, size, and locations of cannisters actually used being dependent upon the size, weight, and configuration of the particular vessel intended to receive the cannisters.

Other and further features, objects, advantages, and benefits of the invention will become apparent from the following description taken in conjunction with the following drawings. It is also to be understood that the foregoing general description and the following detailed description are exemplary and explanatory but are not to be restrictive of the invention. The accompanying drawings which are incorporated in and constitute a part of this invention, illustrate some of the embodiments of the invention and, together with the description, serve to explain the principles of the invention in general terms. Like numerals refer to like parts throughout the disclosure.

DESCRIPTION OF THE PREFERRED EMBODIMENTS

Figure 1:
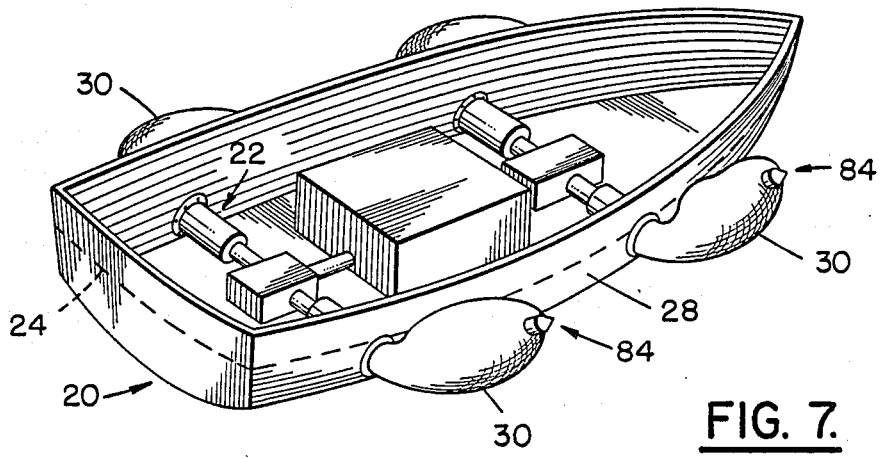
FIG. 1 is a prospective view of a vessel incorporating the invention.
Figure 2:
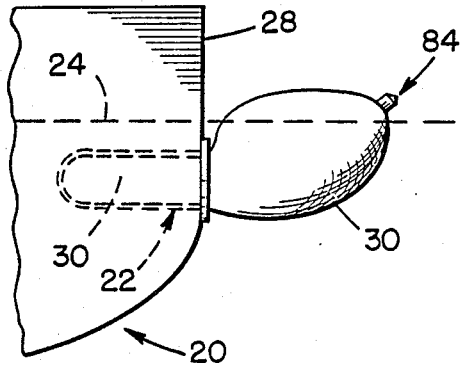
FIG. 2 is a detail and elevation view of the vessel illustrated in FIG. 1.

Turn now to the drawings and initially to FIGS. 1 and 2 which illustrates a boat 20 which is equipped with the auxiliary flotation apparatus of the invention as depicted by the cannisters 22. Four of the cannisters 22 are illustrated in FIG. 1, two of them at spaced locations on the starboard side beneath the water line 24 and two of them at similarly located spaced locations on the port side. As seen in FIGS. 1 and 2, each cannister 22 is in the form of a generally tubular housing having a longitudinal axis and fittingly received transversely through an opening 26 (see FIGS. 3 and 4) in the hull 28 of the boat 20. Also as seen in FIGS. 1 and 2, each of the cannisters 22 is illustrated in its activated or deployed condition whereby an inflatable tubular sheath 30 of flexible, air impermeable, sheet material has been expanded to an inflated, operative, condition and thereby serves as supplemental flotation for the boat 20.

The mechanism which enables deployment of the sheath 30 in the manner illustrated will now be described with particular reference to FIG. 3. As seen therein, the tubular housing of the cannister 22 includes a central member 32 extending from an inboard end distant from the hull of the vessel and an outboard end adjacent to the hull and, further, has a diameter smaller than the opening 26 formed through the hull. A cylindrical mounting member 34 is integral with the outboard end of the central member 32 being joined thereto by a first annular flange 36. The mounting member 34 has a diameter larger than that of the central member 32 and, indeed, is fittingly engageable with the opening 26 formed in the hull 28. A second annular flange 38 is formed at the extreme outboard end of the housing and, through the mounting member 34 and first annular flange 36, is integral with the central member 32. Both the first and second annular flanges 36 and 38 lie in planes which are substantially perpendicular to the cylindrical planes of the central member 32 and mounting member 34, and therefore to the longitudinal axis of the cannister 22. Additionally, the second annular flange 38 is provided with a plurality of circumferentially spaced holes, each of which serves to receive an associated bolt 40, or other suitable fastener, which, together with an associated nut 42 is capable of joining the entire cannister 22 to the hull 28. Suitable gaskets 44, 46, and 48 of appropriate material are associated with the bolts 40, nuts 42, and with the flanges 36 and 38 for sealing the interface between the flanges and the hull 28.

Figures 3, 6:
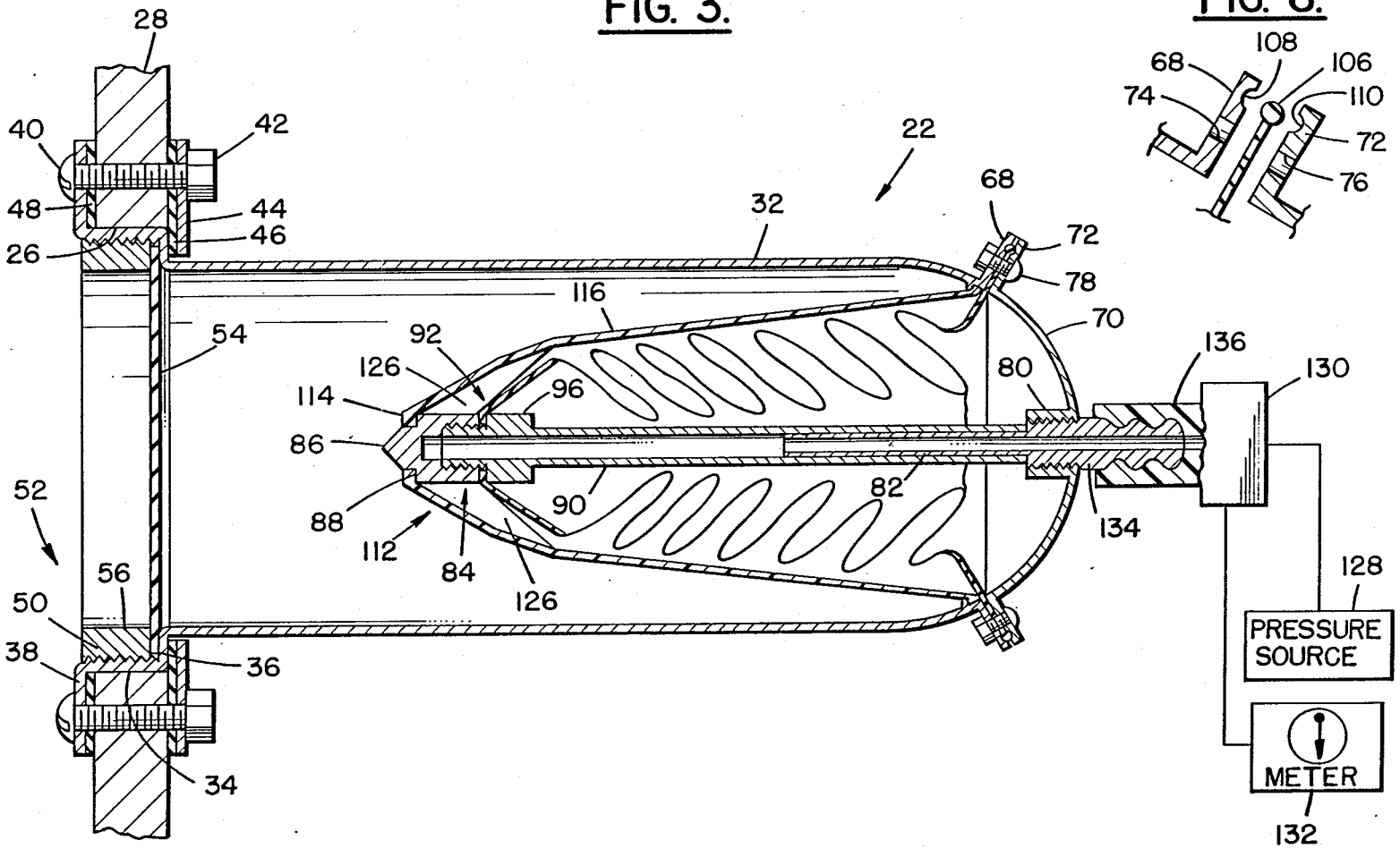
FIG. 3 is a longitudinal cross section view, partly schematic, of the invention as it is installed and in its retracted condition, ready for use.
FIG. 6 is a detail cross section view of other parts illustrated in FIG. 3.

With continued attention directed toward FIG. 3, it is noteworthy that the mounting member 34 is internally threaded as at 50 which enables mounting of a closure mechanism 52 suitable to assure the water tight integrity of the hull 28 at the location of the cannister 22. Specifically, a membrane of suitable frangible material in the form of a circular disk 54 is provided such that it has a diameter substantially equal to the inner diameter of the mounting member 34. Additionally, the closure mechanism 52 includes an externally threaded ring 56 which is threadedly engageable with the mounting member 34. When the ring 56 is threaded to its tightened condition, it compresses the circular disk 54 into sealing engagement with the first annular flange 36 insuring water tight integrity at the outboard end of the cannister 22. Of course, it may be desirable to provide an additional sealing mechanism at the interface between the disk 54 and the flange 36, but any such additional expedient is consider to be within the scope of the present invention.

For reasons which will become clear as the description of the invention continues, it is desired that the circular disk 54 be composed of a material, and be of a sufficient thickness, to withstand the pressure of the water against it. At the same time, it is intended that it be frangible in the manner about to be described and, when so broken, should either be completely shattered, or be sufficiently flexible so as not to cause harm to the sheath 30 when the sheath is drawn through the closure mechanism 52.

Figures 4, 5, 5A, 9:
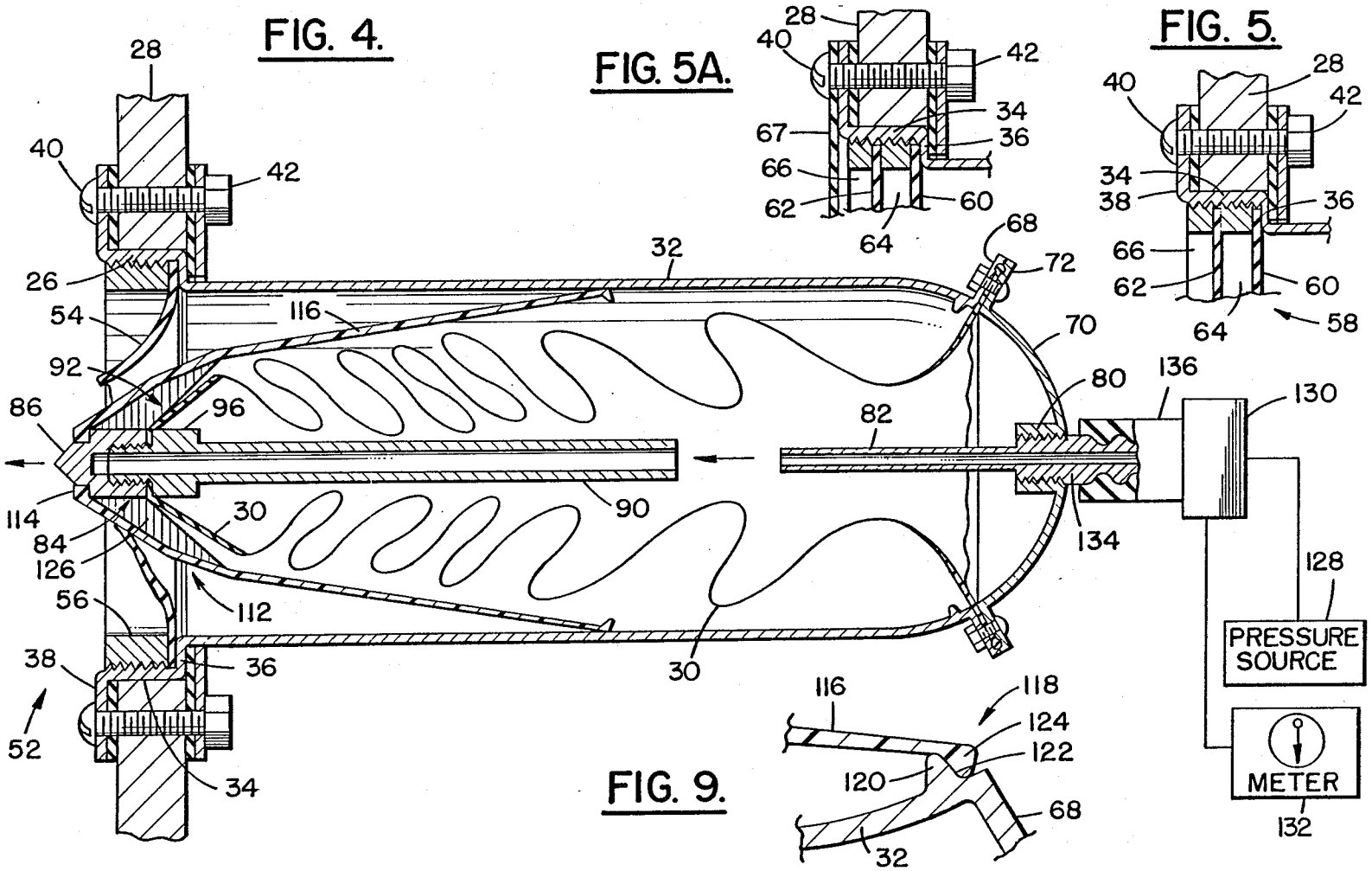
FIG. 4 is a cross section view, similar to FIG. 3, but illustrating the invention after it has been activated and in its intermediate position.
FIG. 5 is a detail cross section view of parts illustrated in FIG. 3.
FIG. 5A is a detail cross section view, similar to FIG. 5, illustrating another embodiment of the invention.
FIG. 9 is a detail cross section view of yet other parts illustrated in FIG. 3.

Turn now to FIG. 5 which illustrates a modified closure member 58. In this instance, a pair of spaced apart circular disks, 60 and 62 respectively, are provided in place of the singular disk 54 of the construction described with respect to FIG. 3. In the instance of the FIG. 5 construction, a pair of externally threaded rings 64 and 66 are utilized to mount the disks 60 and 62 to the outboard end of the housing of the cannister 22. To this end, the ring 64 is engageable with the disk 60 to compress it into sealing engagement with the annular flange 36. Thereafter, the ring 66 is tightened to engage the disk 62 and compress it into sealing engagement with the ring 64. This construction provides some measure of redundancy in that, should one of the disks 60, 62 unintentionally fail, a back-up disk is provided to maintain the water tight integrity of the unit. While an additional number of disks and rings may be utilized and be within the scope of the invention, it is considered that there is a diminishing return if more than a pair of disks are utilized. It will also be appreciated that by reason of the construction of either of the closure mechanisms 52 (FIG. 3) or 58 (FIG. 5), it is substantially flush with the surface of the hull 28 and provides a minimum of drag as the vessel proceeds through the water. This concept would be optimized if a disk 67 were provided in the manner illustrated in FIG. 5A.

Returning to FIG. 3, it is seen that the central member 32 is provided at its inboard end with an annular lip 68 (see FIG. 6 for added detail). Enclosing inboard end of the cannister 22 is a cap member 70 which includes a second annular lip 72 which is matingly engageable with the first annual lip 68. Mating holes 74 and 76 (see FIG. 6) formed at circumferentially spaced locations, respectively, in the lips 68 and 72 are provided to receive suitable fasteners 78 for releasably mounting the ca member 70 to the central member 32.

The cap member 70 is formed with a threaded boss 80 which is coaxial with the longitudinal axis of the central member 32. A hollow needle 82 is threadedly mounted to the boss 80 and extends into the interior of the central member 32, also being substantially coaxial with the longitudinal axis thereof.

With continuing attention to FIG. 3, a projectile 84 is illustrated positioned initially within the central member 32 in a retracted condition distant from the closure mechanism 52. The projectile 84 is also coaxial with the central member 32 and includes a nose 86 at a leading end with an annular shoulder 88 formed thereon. The projectile 84 also includes an elongated hollow stem 90 at a trailing end opposite the leading end as defined by the nose 86. The inner diameter of the stem 90 is slightly larger than the outer diameter of the needle 82 enabling the hollow stem to be slideably received on the needle.

Figure 7:
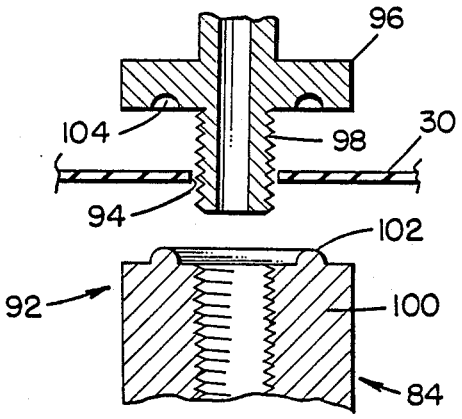
FIG. 7 is a detail exploded cross section view of still other parts illustrated in FIG. 3.

The projectile 84 also includes a clamping member 92 (see especially FIG. 7) located intermediate its leading and trailing ends for sealingly attaching the sheath 30 to the projectile.

It was previously explained, when discussing the construction of FIGS. 1 and 2, that the sheath 30 is inflatable and extends outwardly beyond the hull 28 to provide supplemental buoyancy for the boat 20. The sheath 30 is preferably composed of a light weight, strong, air impermeable material and is generally tubular shaped and has a centrally disposed aperture 94 (see FIG. 7). A male vise element 96 has a threaded shank which extends through the aperture 94 and is threadedly engageable with a female vise element 100. To assure an air tight connection between the projectile 84 and the sheath 30, the vise element 100 is formed with a circular bead 102 which matingly engages with a circular groove 104 thereby firmly gripping the sheath 30 as the vise element 96 is tightened into engagement with the vise element 100.

The sheath 30 has a continuous terminal rim 106 (FIG. 6) distant from the projectile 84 and engageable between the annular lips 68 and 72. To insure air tight integrity between the sheath 30, the central member 32, and the cap member 70, circular grooves 108, 110, with a radius of curvature less than that of the rim 106 are formed, respectively, in the lips 68 and 72.

Another component included in the construction of the cannister 22 is a spider mechanism 112 which is releasably mounted on the projectile 84 and moves with the projectile for cradling and guiding the sheath 30 as the projectile 84 advances through the central member 32 and through the closure mechanism 52 in a manner to be described.

Figure 8:
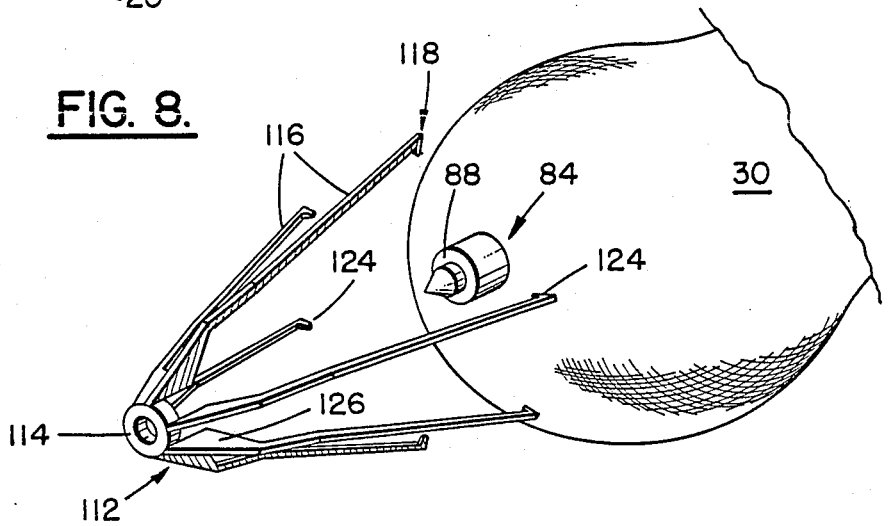
FIG. 8 is a detail perspective view of the invention as it is approaching its final condition after being activated.

As seen especially in FIGS. 3 and 8, the spider mechanism includes a central ring member 114 and a plurality of legs 116 which are integral with the ring member 114 and extend away therefrom at a plurality of equally spaced circumferential locations. The spider mechanism is composed of suitable resilient material and the legs 116 extend away from the ring member 114 both radially towards the central member 32 and longitudinally toward the inboard end thereof. The legs 116 are generally symmetrical in relation to the longitudinal axis of the central member 32 and terminate at tip ends 118 which are biased radially outwardly into engagement with the central member 32.

A detent mechanism is employed for releasably holding the spider mechanism 112 on the projectile 84 and, in turn, holding the projectile in the retracted condition. To this end, viewing especially FIG. 9, an annular shelf 120 is formed integral with the central member 32 at its inboard end and defines an annular groove 122 which generally faces in the direction of the ca member 70. Knob members 124 at the tip ends of the legs 116 are engageably received by the annular groove 122 when the projectile 84 is in the retracted condition as illustrated in FIG. 3. However, the annular groove 122 is so formed that the knob members 124 are readily releasable therefrom when the projectile begins to move from the retracted condition illustrated in FIG. 3 to that illustrated in FIG. 4.

Each of the legs 116 also includes a web portion 126 which bears against the outer peripheral surface of the projectile 84 when the projectile is in the retracted condition illustrated in FIG. 3. This construction adds to the bias of the legs 116 in the radial outward direction to normally hold the knob members 124 at the tip ends 118 engaged with the annular groove 122.

With particular attention to FIGS. 1, 3, and 4, it is seen that the system of the invention includes a suitable source of pressurized air 128 and a valve mechanism 130 intermediate the source 128 and the needle 82 which is operable for selectively directing pressurized air through the needle and into the hollow stem 90. The valve mechanism 130 may be automatically operated in response to an inclinometer 132 which registers the inclination or heeling of the boat to greater than a predetermined amount or for longer than a predetermined period of time. Of course, it will be understood that the valve mechanism 130 can be operated manually or in response to some other appropriate condition other than inclination which indicates the presence of a serious situation. The end of the needle 82 inboard of the cap member 70 is a fitting 134 to which flexible tubing 136 is attached to connect the valve mechanism 130 to the needle 82. While the source 128 and inclinometer 132 and other associated sensing and operating components may be provided centrally and each cannister 22 releasably connected thereto, it may be desirable for each cannister to be entirely self-contained and operated.

In the operation of the system of the invention, when a serious condition involving the boat 20 comes to pass, the valve mechanism 130 can be operated either manually or automatically, in some suitable manner, to direct pressurized air through the tubing 136 into the needle 82, then into the hollow stem 90 of the projectile 84. When this occurs, the projectile which is positioned initially within the cannister 22 in a retracted condition distant from the closure mechanism 52, is propelled in an outboard direction to a location distant from the hull of the boat. As the projectile proceeds, it engages, then ruptures, the circular disk 54 then continues on to the distant location. When the projectile exits from the hull of the boat, the needle 82 continues to direct pressurized air into the sheath, thereby causing the sheath to expand to its inflated, operative, condition as it is drawn by the projectile to the distant location.

While the knob members 124 of the spider mechanism 112 initially hold the projectile in its retracted condition, as the projectile begins its movement in the direction of the closure mechanism, the knob members 124 are caused to be released from the annular groove 122 and are drawn along by the projectile with the knob members 124 engaging and sliding along the interior surface of the central member 132. The legs 116 of the spider mechanism serve to cradle the sheath 30 and carefully guide it along the central member 32 and through the closure member 52 until its outboard surfaces have advanced beyond the hull of the boat. At this point, as indicated in FIG. 8, the spider mechanism 112, by reason of its weight, becomes disengaged from the projectile and falls away through the water leaving the projectile free to continue with the sheath 30 to its distant location. The ultimate, buoyant condition of the sheath 30 in the instance of each associated cannister 22 is illustrated in FIGS. 1 and 2.

While preferred embodiments of the invention have been disclosed in detail, it should be understood by those skilled in the art that other modifications may be made to the illustrated embodiments without departing from the scope of the invention as described in the specification and defined in the appended claims

What is claimed is:

1. Auxiliary flotation apparatus for a vessel comprising:

a tubular housing having a longitudinal axis intended for fitting reception transversely through an opening in the hull of a vessel at a location below the water line thereof extending between an outboard end and an inboard end and including an annular flange thereon at said outboard end for mounting said housing on the vessel and a first annular lip at said inboard end;

a cap member including a second annular lip matingly engageable with said first annular lip for enclosing said inboard end of said housing;

closure means releasably engageable with said outboard end of said housing and including frangible membrane means to normally isolate the interior of said housing from the exterior of the vessel;

a projectile positioned initially within said housing in a retracted condition distant from said closure member and operable to be propelled in an outboard direction to a location distant from the hull of the vessel and, en route, to rupture said membrane means;

an elongated hollow stem integral with said projectile and generally coaxial with the longitudinal axis of said housing when said projectile is in said retracted position;

an inflatable tubular sheath of flexible, air impermeable, sheet material attached to said projectile and having a continuous terminal rim distant from said projectile, said sheath being movable with said projectile between a retracted, deflated, inoperative condition folded within said housing and an inflated, operative condition extending through said closure means to the distant location, said terminal rim being sealingly fixed between said first and second annular lips when said cap member is mounted to said housing;

a source of pressurized air;

an elongated hollow air needle mounted on said cap member and connected to said source of pressurized air, said air needle being coaxial with and extending into said hollow stem when said projectile is in the retracted position; and valve means intermediate said source of pressurized air and said air needle operable for selectively directing pressurized air through said air needle and into said hollow stem to propel said projectile to said distant location, said air needle continuing to direct pressurized air into said sheath, thereby causing said sheath to expand to its inflated, operative, condition as it is drawn by said projectile to said distant location;

whereby said sheath in its inflated, operative condition serves as supplemental flotation for the vessel.

2. Auxiliary flotation apparatus for a vessel as set forth in claim 1 including:

spider means releasably mounted on said projectile and movable therewith for cradling and guiding said tubular sheath as said projectile advances through said housing to said distant location.

3. Auxiliary flotation apparatus for a vessel comprising:

a tubular housing having a longitudinal axis intended for fitting reception transversely through an opening in the hull of the vessel at a location below the water line thereof and extending between an inboard end and an outboard end;

closure means at said outboard end including frangible membrane means to normally isolate the interior of said housing from the exterior of the vessel;

a projectile positioned initially within said housing in a retracted condition distant from said closure means and operable to be propelled in an outboard direction to a location distant from the hull of the vessel and, en route, to rupture said membrane means;

an inflatable tubular sheath of flexible, air impermeable, sheet material sealingly attached at one end to said projectile and having a continuous terminal rim distant therefrom sealingly fixed to said inboard end of said housing, said one end capable of being drawn with said projectile upon movement thereof from said retracted condition within said housing to an extended condition stretching from said inboard end of said housing, through said closure member, to said projectile at said distant location;

a source of pressurized air; and operating means for selectively directing said source to effect movement of said projectile from said retracted condition to said location distant from the hull of the vessel, and for causing said sheath to expand from a collapsed, deflated condition, to an inflated condition as it stretches from said inboard end of said housing, through said closure member, to said projectile at said distant location;

whereby said sheath serves as supplemental flotation for the vessel.

4. Auxiliary flotation apparatus for a vessel as set forth in claim 3 including:

an annular flange on said housing at said outboard end adapted for contiguous reception with the outer surface of the hull; and fastener means for attaching said flange to the hull.

5. Auxiliary flotation apparatus for a vessel as set forth in claim 4 including:

gasket means associated with said fastener means and with said annular flange for sealing the interface between said flange and the hull.

6. Auxiliary flotation apparatus for a vessel as set forth in claim 3 wherein said housing is substantially cylindrical and includes:

a central member having a diameter smaller than the opening through the hull of the vessel;

a cylindrical mounting member having a diameter larger than the diameter of said central member and having an outer surface fittingly engageable with the opening in the hull;

a first annular flange intermediate and integral with said central member and said mounting member; and a second annular flange at the extreme outboard end of said housing adapted for contiguous reception with the outer surface of the hull; and including:

fastener means for attaching said second annular flange to the hull.

7. Auxiliary flotation apparatus for a vessel as set forth in claim 6 including:

gasket means associated with said fastener means and with said first and second annular flanges for sealing the interface between said flanges and the hull.

8. Auxiliary flotation apparatus for a vessel as set forth in claim 6 wherein said central member has a first annular lip at said inboard end; and including:

a cap member having a second annular lip matingly engageable with said first annular lip for enclosing said inboard end of said housing.

9. Auxiliary flotation apparatus for a vessel as set forth in claim 8 wherein said projectile includes:

a nose at a leading end;

an elongated hollow stem at a trailing end opposite said leading end; and a clamping member intermediate said leading and trailing ends for sealingly attaching said sheath thereto; and wherein said operating means includes: valve means; and a hollow needle in communication with said valve means sealingly attached to said cap member, said needle being received within said elongated stem and coaxial therewith when said projectile is in said retracted condition;

said valve means being selectively cooperable for directing pressurized air into and through said hollow stem to propel said projectile to said distant location, said needle continuing to direct pressurized air into said sheath, thereby causing said sheath to expand to its inflated, operative, condition as it is drawn by said projectile to said distant location.

10. Auxiliary flotation apparatus for a vessel as set forth in claim 9 wherein said nose has an annular shoulder formed thereon; and including:

spider means releasably mounted on said projectile and movable therewith for cradling and guiding said tubular sheath as said projectile advances through said housing and through said closure means, said spider means including:

a central ring member loosely received on said annular shoulder formed on said nose; and a plurality of resilient elongated legs integral with said ring member and extending from a plurality of equally spaced circumferential locations both radially toward said housing and longitudinally toward said inboard end of said housing, said legs being generally symmetrical in relation to said longitudinal axis and terminating at tip ends which are biased radially outwardly into engagement with said housing.

11. Auxiliary flotation apparatus for a vessel as set forth in claim 6 wherein said mounting member is internally threaded;

wherein said membrane means is a circular disk with a diameter substantially equal to the inner diameter of said mounting member; and wherein said closure means includes an externally threaded ring threadedly engageable with said mounting member for compressing said circular disk into sealing engagement with said first annular flange.

12. Auxiliary flotation apparatus for a vessel as set forth in claim 11 wherein said membrane means includes first and second spaced apart circular disks, each with a diameter substantially equal to that of said mounting member; and wherein said closure means includes first and second externally threaded rigs, each being threadedly engageable with said mounting member, said first ring being engageable with said first circular disk for compressing said first circular disk into sealing engagement with said first annular flange, said second ring being engageable with said second circular disk for compressing said second circular disk into sealing engagement with said first ring.

13. Auxiliary flotation apparatus for a vessel as set forth in claim 3 including:

spider means releasably mounted on said projectile and movable therewith for cradling and guiding said tubular sheath as said projectile advances through said housing and through said closure means.

14. Auxiliary flotation apparatus for a vessel as set forth in claim 13 wherein said projectile is coaxial with said housing and includes:

a nose at a leading end having an annular shoulder formed thereon;

an elongated hollow stem at a trailing end opposite said leading end; and a clamping member intermediate said leading and trailing ends for sealingly attaching said sheath thereto; and wherein said spider means includes:

a central ring member loosely received on said annular shoulder formed on said nose; and a plurality of resilient elongated legs integral with said ring member and extending from a plurality of equally spaced circumferential locations both radially toward said housing and longitudinally toward said inboard end of said housing, said legs being generally symmetrical in relation to said longitudinal axis and terminating at tip ends which are biased radially outwardly into engagement with said housing.

15. Auxiliary flotation apparatus for a vessel as set forth in claim 14 including:

detent means for releasably holding said spider means on said projectile and, in turn, said projectile in said retracted condition.

16. Auxiliary flotation apparatus for a vessel as set forth in claim 15 wherein said detent means includes:

an annular shelf adjacent said inboard end of said housing, said annular shelf formed with an aft facing annular groove; and knob members at said tip ends of said legs engageably received by said annular groove when said projectile is in said retracted condition but releasable from said annular groove as said projectile begins to move toward said closure means.

17. Auxiliary flotation apparatus for a vessel as set forth in claim 13 wherein said projectile includes:

a nose at a leading end;

an annular shoulder formed on said nose thereof; and wherein said spider means includes:

a central ring member loosely received on said annular shoulder formed on said nose, a plurality of resilient elongated legs integral with said ring member and extending from a plurality of equally spaced circumferential locations both radially toward said housing and longitudinally toward said inboard end of said housing, said legs generally symmetrical in relation to said longitudinal axis and terminating at tip ends which are biased radially outwardly into engagement with said housing.

* * * * *